US012473741B2

(12) United States Patent
Zeng et al.

(10) Patent No.: US 12,473,741 B2
(45) Date of Patent: Nov. 18, 2025

(54) POOL CLEANING DEVICE

(71) Applicant: BESTWAY INFLATABLES & MATERIAL CORP., Shanghai (CN)

(72) Inventors: Xianglin Zeng, Shanghai (CN); Qingshui Song, Shanghai (CN); Wenhua Hu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 370 days.

(21) Appl. No.: 18/111,984

(22) Filed: Feb. 21, 2023

(65) Prior Publication Data

US 2024/0052662 A1 Feb. 15, 2024

(30) Foreign Application Priority Data

Aug. 9, 2022 (CN) ..... 202222079902.1

(51) Int. Cl.
*E04H 4/16* (2006.01)
*B63H 1/02* (2006.01)
*B63H 5/00* (2006.01)

(52) U.S. Cl.
CPC ..... *E04H 4/1654* (2013.01); *B63H 1/02* (2013.01); *B63H 5/00* (2013.01)

(58) Field of Classification Search
CPC ..... E04H 4/1654; B63H 1/02; B63H 5/00
See application file for complete search history.

(56) References Cited

U.S. PATENT DOCUMENTS

2007/0157413 A1 7/2007 Roumagnac
2022/0018149 A1 1/2022 Chen

FOREIGN PATENT DOCUMENTS

CA 2987680 4/2017

OTHER PUBLICATIONS

Extended European Search Report dated Jan. 18, 2024 (Jan. 18, 2024), 4 Pages, issued on related European Patent Application 23160374.7 by the European Patent Office.

*Primary Examiner* — Sabbir Hasan
(74) *Attorney, Agent, or Firm* — Dickinson Wright PLLC

(57) ABSTRACT

A pool cleaning device is provided, including: a main body; a rotating unit rotatably disposed on the main body, the rotating unit including a rotating member, a fluid outlet extending radially outward from the rotating member, and a first positioning protrusion extending radially outward from the rotating member and spaced apart from the fluid outlet; and a reversing member including a plurality of stoppers spaced apart from each other and disposed along a path of rotation of the rotating member. Each of the plurality of stoppers is reciprocable between a position in a path of rotation of the first positioning protrusion and a position out of the path of rotation of the first positioning protrusion.

20 Claims, 10 Drawing Sheets

POOL CLEANING DEVICE

CROSS-REFERENCE TO RELATED APPLICATION

This Application claims priority from Chinese Application CN202222079902.1, filed Aug. 9, 2022 in China, the disclosure of which is incorporated herein by reference in its entirety.

BACKGROUND

1. Field

Apparatuses and methods consistent with exemplary embodiments relate to cleaning apparatuses and in particular to a pool cleaning device.

2. Description of the Related Art

Swimming pools must be cleaned frequently. For example, a pool bottom cleaning robot is often used to clean a pool bottom. Upon reaching a wall of a pool, the cleaning robot must reverse and turn back.

However, conventional robots often fail to implement an accurate and stable reversing movement, and often spin in the same place, resulting in inefficient cleaning.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, a pool cleaning device comprises: a main body; a rotating unit rotatably disposed on the main body, the rotating unit comprising: a rotating member, a fluid outlet extending radially outward from the rotating member, and a first positioning protrusion extending radially outward from the rotating member and spaced apart from the fluid outlet; and a reversing member comprising a plurality of stoppers spaced apart from each other and disposed along a path of rotation of the rotating member, wherein each of the plurality of stoppers is reciprocable between a position in a path of rotation of the first positioning protrusion and a position out of the path of rotation of the first positioning protrusion.

The plurality of stoppers may be synchronously rotatable, and a path of rotation of each of the plurality of stoppers may intersect with the path of rotation of the first positioning protrusion; and each of the stoppers may be disposed at an angle, with respect to a vertical direction, different from an angle at which each other of the stoppers is disposed.

The plurality of stoppers may comprise a first stopper and a second stopper arranged symmetrically with respect to a moving direction of the pool cleaning device; the first stopper comprising a first stop position and a second stop position, the first stop position and the second stop position being on a first circumference and spaced apart; the second stopper comprising a third stop position and a fourth stop position, the third stop position and the fourth stop position being on a second circumference and spaced apart; and projections, toward each other, of an arc segment between the first stop position and the second stop position and a corresponding arc segment between the third stop position and the fourth stop position are orthogonal; and along the rotation path of the first positioning protrusion, the fluid outlet arranged at a right angle to the first positioning protrusion.

The first stopper may comprise a first curved plate and the second stopper may comprise a second curved plate.

The first stopper may comprise a first blocking bar forming the first stop position and a second blocking bar spaced apart from the first blocking bar and forming the second stop position; and the second stopper may comprise a third blocking bar forming the third stop position and a fourth blocking bar spaced apart from the third blocking bar and forming the fourth stop position.

Each of the first stopper and the second stopper may be rotatably disposed on the main body.

The reversing member may further comprise a buoyant plate, the buoyant plate extending across the rotating member and connected to the first stopper and the second stopper; and the rotating unit may further comprise a second positioning protrusion extending radially outward from the rotating member, spaced apart from the first positioning protrusion, and disposed higher than the first positioning protrusion.

The pool cleaning device may further comprise: a first mounting base extending upward from the main body; a second mounting base extending upward from the main body and symmetrically disposed with respect to the first mounting base; wherein a first end of the buoyant plate is rotatably mounted on the first mounting base, a second end of the buoyant plate is rotatably mounted on the second mounting base, the first stopper is disposed on the first end of the buoyant plate, the second stopper is disposed on the second end of the buoyant plate, facing the first stopper.

The plurality of stoppers may comprise a first stopper and a second stopper arranged symmetrically with respect to a moving direction of the pool cleaning device; the reversing member may further comprise a buoyant plate which extends across the rotating member and comprises a first end rotatably connected to the first stopper and a second end rotatably connected to the second stopper, such that: when the pool cleaning device is moving in a first direction, a combination of buoyancy of the buoyant plate and pressure from surrounding water maintains the buoyant plate in an inclined state; when the pool cleaning device is not moving, the buoyancy of the buoyant plate lifts the buoyant plate into a vertical state; and when the pool cleaning device is moving in a second direction, a combination of the buoyancy of the buoyant plate and pressure from surrounding water maintains the buoyant plate the inclined state again.

The first positioning protrusion may comprise an edge having a recessed-arc shape corresponding to a shape of the first stopper, and the second positioning protrusion may comprise an edge having a recessed-arc shape corresponding to a shape of the second stopper.

The pool cleaning device may further comprise: an electric motor and a transmission mechanism; wherein the rotating unit further comprises a housing and an impeller disposed in the housing; and wherein the electric motor is operatively coupled to the impeller via the transmission mechanism.

The electric motor may be disposed in the main body; the main body may comprise a first shaft hole formed therethrough, the housing may comprise a second shaft hole formed therethrough in a position corresponding to a position of the first shaft hole; and the transmission mechanism may extend through the first shaft hole, through the second shaft hole, and be operatively connected to the electric motor and to the impeller.

The pool cleaning device may further comprise a plurality of back vanes disposed on an outer surface of the impeller and extending away from the main body.

The pool cleaning device may further comprise: an annular groove formed sin a surface of one of the main body and the housing around a corresponding one of the first shaft hole and the second shaft hole, and an annular wear-resistant part mounted in the annular groove.

The pool cleaning device may further comprise a bearing is vertically disposed between the housing and the main body, thereby spacing the housing apart from the main body.

The pool cleaning device may further comprise: a first hook extending vertically in an area of the main body corresponding to the housing, and a second hook extending vertically in an area of the housing corresponding to the main body; wherein the bearing comprises an outer race, an inner race, and rollers disposed between the outer race and the inner race; and wherein the outer race is mounted to the first hook, and the inner race is mounted to the second hook.

The pool cleaning device may further comprise a counterweight disposed in the main body.

The pool cleaning device may further comprise a plurality of counterweights uniformly distributed within the main body.

The counterweight may comprise one of a weight block and a buoyant block.

According to an aspect of another example embodiment, a pool cleaning device may comprise: a main body; a rotating unit rotatably disposed on the main body, the rotating unit comprising: a rotating member, a fluid outlet extending radially outward from the rotating member, a first positioning protrusion extending radially outward from the rotating member, and a second positioning protrusion, spaced apart from the first positioning protrusion and extending radially outward from the rotating member; and a reversing member comprising: a first stopper and a second stopper arranged symmetrically with respect to a moving direction of the pool cleaning device, and a buoyant plate extending across the rotating member and connected to the first stopper and the second stopper; wherein the pool cleaning device is positionable into: a first service state in which the pool cleaning device moves in a first direction, the buoyant plate is in an inclined state, the first stopper stops the first positioning protrusion, and the fluid outlet is oriented in a second direction opposite the first direction; a transition state in which the pool cleaning device stops moving, the buoyant plate is rotated into a vertical state, the first stopper is rotated to separate from the first positioning protrusion, the rotating member rotates until the second stopper contacts the second positioning protrusion, and the fluid outlet is oriented in the first direction, and a second service state in which the buoyant plate is deflected into the inclined state, the second stopper rotates past the second positioning protrusion until the second stopper contacts the first positioning protrusion, and the fluid outlet remains oriented in the first direction.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
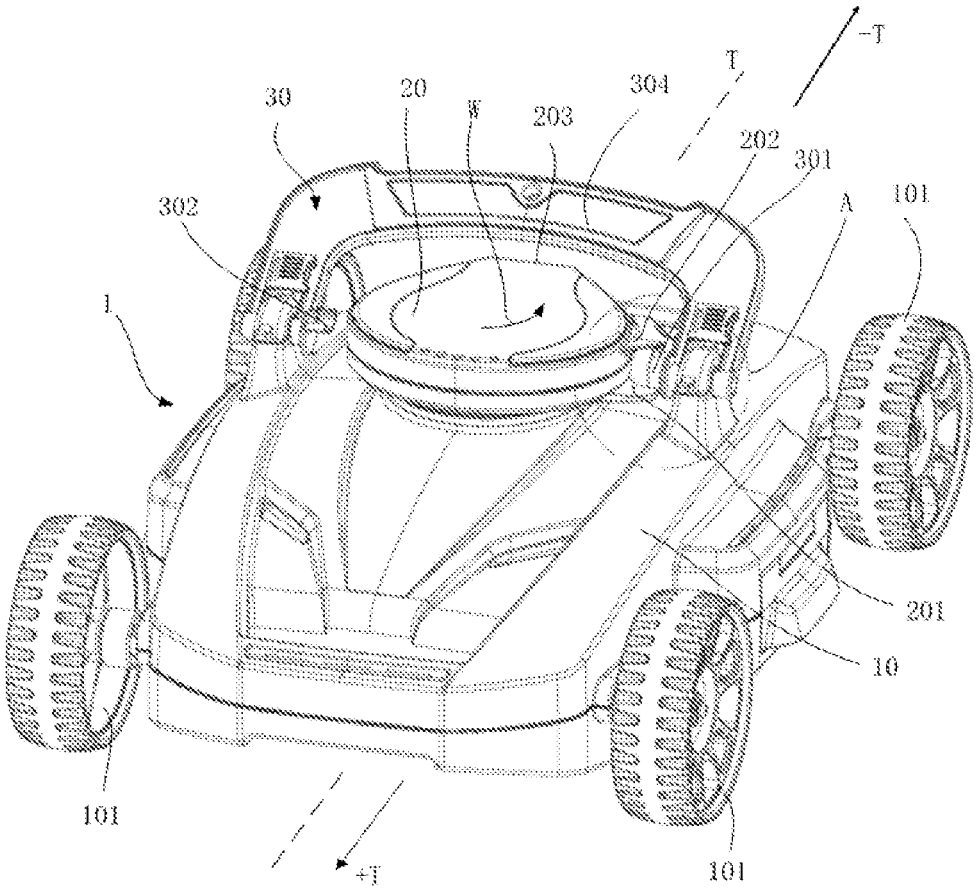
FIG. 1 schematically shows a pool cleaning device in a moving state according to a first example embodiment.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these exemplary embodiments pertain may not be described here in detail.

As used herein, the directional term "transverse" refers to a direction substantially perpendicular to an axial direction of a component. As used herein, the term "horizontal" does not refer to an absolute horizontal plane, but rather to a direction substantially parallel to a bottom surface of a pool to be cleaned by a pool cleaning device; and the term "vertical" refers to a direction substantially perpendicular to the "horizontal" direction. The terms "above" and "below" are both used with reference to the "vertical" direction.

FIG. 1 schematically shows a pool cleaning device 1 according to a first example embodiment. As shown in FIG. 1, the pool cleaning device 1 comprises a main body 10, a rotating member 20, and a reversing member 30. The rotating member 20 is rotatably disposed on the main body 10 in a horizontal direction. The rotating member 20 is transversely provided with a fluid outlet 203 and a first positioning protrusion 201 that is spaced apart from the fluid outlet 203 and extends transversely outward from the rotating member 20. The fluid outlet 203 is configured to spray water outward from the rotating member to thereby provide power for the pool cleaning device 1 to move. When the rotating member 20 circumferentially rotates relative to the main body 10 in the horizontal direction, the orientation of the fluid outlet 203 changes accordingly relative to the main body 10. The reversing member 30 comprises a plurality of stoppers 303 (see FIG. 2) spaced apart along a rotation path of the rotating member 20. The plurality of stoppers 303 are adapted to reciprocate and thereby enter or leave the rotation path of the first positioning protrusion 201 to respectively prevent the rotating member 20 from rotating and allow the rotating member 20 to pass thereby, thus changing the orientation of the fluid outlet 203 relative to the main body 10.

During use of the pool cleaning device 1, one stopper enters the rotation path of the first positioning protrusion 201, the rotating member 20 is stopped at a certain angle and the fluid outlet 203 is accordingly oriented at the certain angle relative to the main body 10, such that the pool cleaning device 1 can move in a specific direction. When the stopper leaves the rotation path of the first positioning protrusion 201 and another stopper enters the rotation path of the first positioning protrusion 201, the rotating member 20 rotates through a certain angle range and then stops at another angle; the fluid outlet 203 is accordingly switched to another angle relative to the main body 10, such that the pool cleaning device 1 can move in another direction. In this way, the stoppers alternatively enter the rotation path of the first positioning protrusion 201, such that the moving direction of the pool cleaning device 1 can be accurately changed, preventing the pool cleaning device 1 from spinning in the same place, and improving cleaning efficiency of the pool cleaning device 1.

As shown in FIG. 1, a shape of the main body 10 is substantially cuboid. Of course, a shape of the main body 10 can also be any of a variety of other shapes, for example, a disc shape, an elliptical disc shape, and a polygonal shape, which will not be described here. The main body 10 substantially in the shape of a cuboid is described herein as one possible example.

The rotating member 20 is mounted on an upper surface of the main body 10. The fluid outlet 203 and the first positioning protrusion 201 each extend substantially parallel to the top surface of the main body 10, that is, in a substantially horizontal direction. Stoppers 303 are also mounted on the top surface of the main body 10. In addition, the stoppers 303 can alternately be mounted on one or more side surfaces of the main body 10, as long as they can prevent the first positioning protrusion 201 or the rotating member 20 from rotating.

The main body 10 is further provided with four wheels 101 to enable the pool cleaning device 1 to move. Optionally, the main body 10 is further provided with a cleaning assembly (not shown in the figure) to clean the pool while the pool cleaning device 1 moves on a bottom surface of the pool.

The plurality of stoppers 303 rotate synchronously, and a rotation path of each of the stoppers 303 intersects with the rotation path of the first positioning protrusion 201. Moreover, at any given moment, the stoppers 303 are at different angles with respect to a vertical direction, such that one of the stoppers 303 stops the first positioning protrusion 201 and the remaining stoppers 303 allow the first positioning protrusion 201 to pass thereby. According to this structure, when it is desirable to adjust a moving direction of the pool cleaning device 1, one of the stoppers 303 may be appropriately selected to enter the rotation path of the first positioning protrusion 201 to prevent the rotating member 20 from rotating and to position the fluid outlet 203 in a predetermined orientation. In addition, a driving component can be used to drive the plurality of stoppers 303 to rotate simultaneously; for example, an electric motor can be used for driving.

Figure 2:
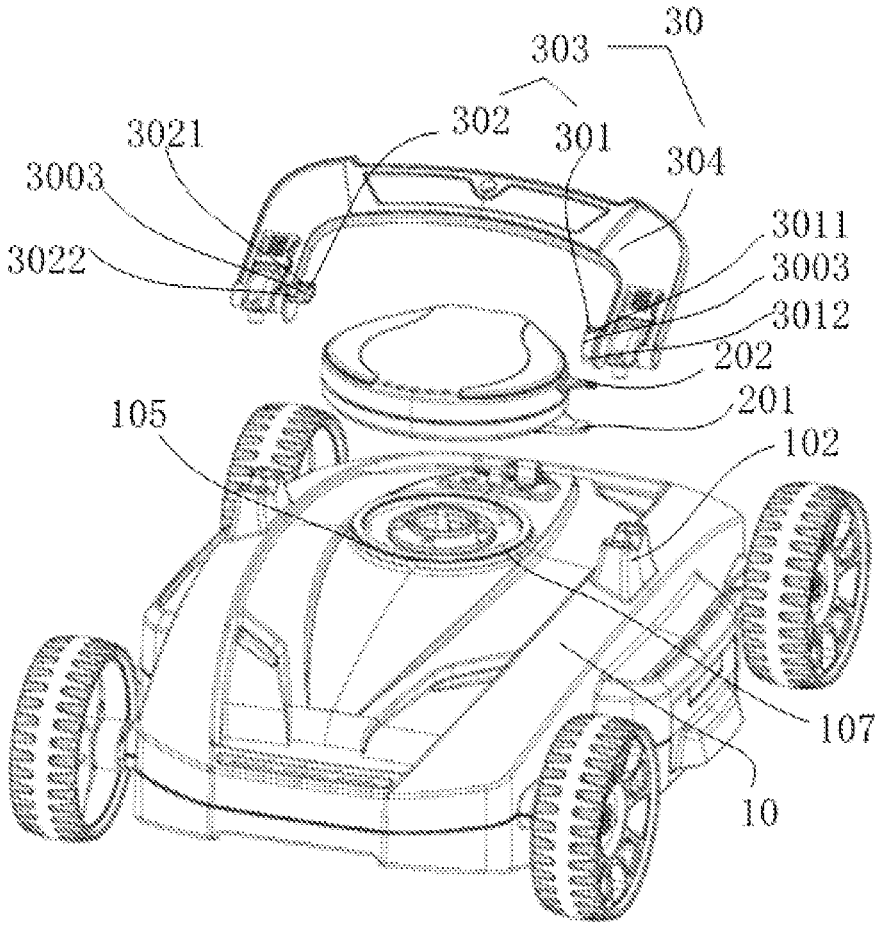
FIG. 2 is an exploded view of FIG. 1.

Optionally, as shown in FIGS. 1 and 2, the stoppers 303 comprise a first stopper 301 and a second stopper 302. The first stopper 301 and the second stopper 302 are rotatably disposed on the main body 10 and are arranged symmetrically with respect to a moving direction T of the pool cleaning device 1. The first stopper 301 has a first stop position 3011 and a second stop position 3012, the first stop position 3011 and the second stop position 3012 being spaced apart along a first circumference which is a circumferential path along which the first stopper 301 rotates. The second stopper 302 has a third stop position 3021 and a fourth stop position 3022, the third stop position 3021 and the fourth stop position 3022 being spaced apart along a second circumference which is a circumferential path along which the second stopper 302 rotates. Projections, toward each other, of an arc segment 3003 between the first stop position 3011 and the second stop position 3012 and a corresponding arc segment 3003 between the third stop position 3021 and the fourth stop position 3022 are orthogonal. In other words, the two arc segments are arranged in different planes and perpendicular to each other. Along the rotation path of the first positioning protrusion 201, the fluid outlet 203 is arranged at a right angle with respect to the first positioning protrusion 201. That is, the fluid outlet 203 is separated from the first positioning protrusion 201 by an angle of 90 degrees. With this structure, the rotating member 20 can only be positioned by the first stop position 3011 and the second stop position 3012 such that the fluid outlet 203 faces forward or backward in the moving direction T, so that the pool cleaning device 1 can only move forward (in a direction +T) or backward (in a direction −T). That is, the pool cleaning device 1 can move in the moving direction T toward a first direction +T or a second direction −T). In this way, when the pool cleaning device 1 needs to reverse and turn back, it is only necessary to select the first stopper 301 or the second stopper 302 to block the rotation of the first positioning protrusion 201 (i.e., the rotating member 20), which greatly facilitates turning back of the pool cleaning device 1 and prevents the pool cleaning device from spinning in a same place.

Figure 4:
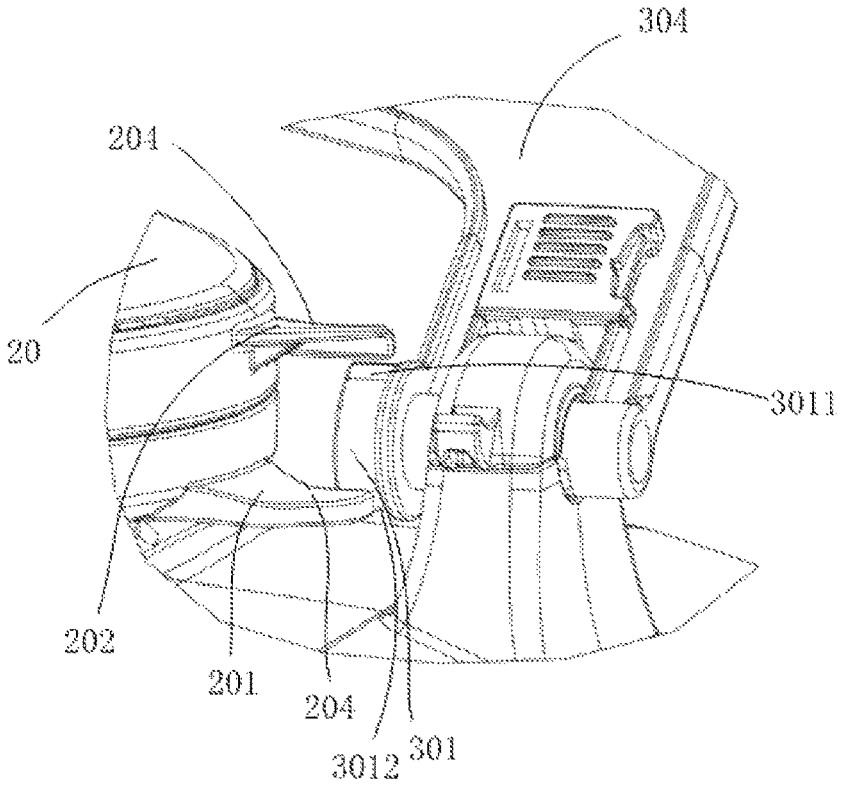
FIG. 4 is an enlarged view of part A of FIG. 1, showing an example stopper in a first form.
Figure 6:
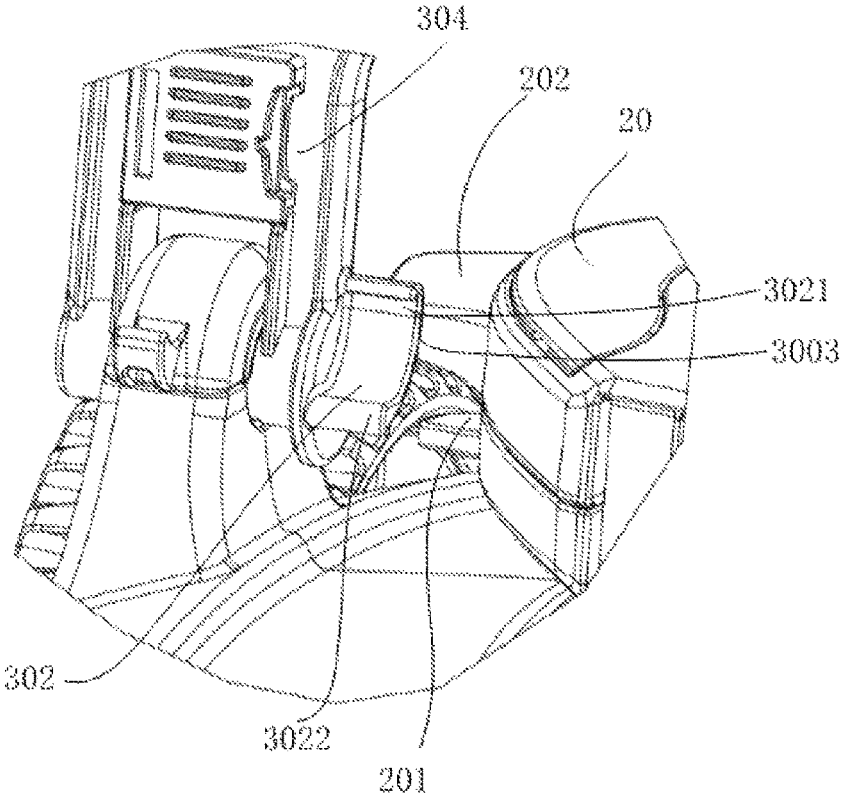
FIG. 6 is an enlarged view of part B of FIG. 5, showing an example stoppering a first form.

FIGS. 4 and 6 show, in an enlarged form, the first stopper 301 and the second stopper 302 of the pool cleaning device 1 according to the first example embodiment. As shown in FIGS. 4 and 6, the first stopper 301 and the second stopper 302 are both curved plates. Radial edges of the curved plate of the first stopper 301 form the first stop position 3011 and the second stop position 3012 as described above. Radial edges of the curved plate of the second stopper 302 form the third stop position 3021 and the fourth stop position 3022 as described above, and projections, toward each other, of the first stopper 301 and the second stopper 302 are orthogonal.

Optionally, the stoppers 303 may also comprise other stoppers provided at other locations to position the fluid outlet 203 to be oriented in other directions, such that the pool cleaning device 1 is able to implement a greater variety of steering movements, which will not be described here.

As shown in FIG. 2, the reversing member 30 further comprises a buoyant plate 304. The buoyant plate 304 extends over the rotating member 20 and is connected to the first stopper 301 and the second stopper 302. For example, the buoyant plate 304, the first stopper 301 and the second stopper 302 may be integrally made of a plastic material with a density less than that of water. As a whole, the buoyant plate 304 is substantially U-shaped, and the first stopper 301 and the second stopper 302 are at two ends of the substantially U-shaped buoyant plate 304. During use of the pool cleaning device 1, the buoyant plate 304 drives the first stopper 301 and the second stopper 302 to rotate synchronously under a combined effect of the buoyancy of the buoyant plate and the resistance of water, which will be described in detail below.

Optionally, the main body 10 is further provided with two mounting bases 102 extending upward. As shown in FIG. 2, the two mounting bases 102 are arranged symmetrically with respect to the moving direction T of the pool cleaning device 1, that is, the two mounting bases 102 are located on opposite sides of the rotating member 20. The two ends of the buoyant plate 304 are rotatably mounted on the mounting bases 102. The first stopper 301 and the second stopper 302 are located at the two ends of the buoyant plate 304 and face each other.

Still as shown in FIGS. 1 and 2, the rotating member 20 is further provided with a second positioning protrusion 202 that transversely extends outward. The second positioning protrusion 202 is located above the first positioning protrusion 201. The second positioning protrusion 202 is located in front of the first positioning protrusion 201 in a rotation direction W of the rotating member 20.

A process of using the pool cleaning device 1 is described below, with the rotating member 20 having the first positioning protrusion 201 and the second positioning protrusion 202 and the reversing member 30 having the first stopper 301, the second stopper 302, and the buoyant plate 304 as an example.

As shown in FIGS. 1 and 4, when the pool cleaning device 1 moves in a first direction (e.g. a forward moving direction +T), the buoyant plate 304 is in an inclined state (e.g., being inclined from the vertical toward a second direction (e.g. a reverse moving direction −T) under the combined effect of buoyancy and resistance of the water. The first stopper 301 deviates from the vertical direction by a small angle, for example, at an angle of substantially 20 degrees with respect to vertical, to stop the first positioning protrusion 201, such that the rotating member 20 cannot rotate, and the fluid outlet 203 is constantly oriented to spray water in the second direction, opposite the first direction. At this point, the second stopper 302 is at an angle of substantially 70 degrees with respect to the vertical direction.

Figure 5:
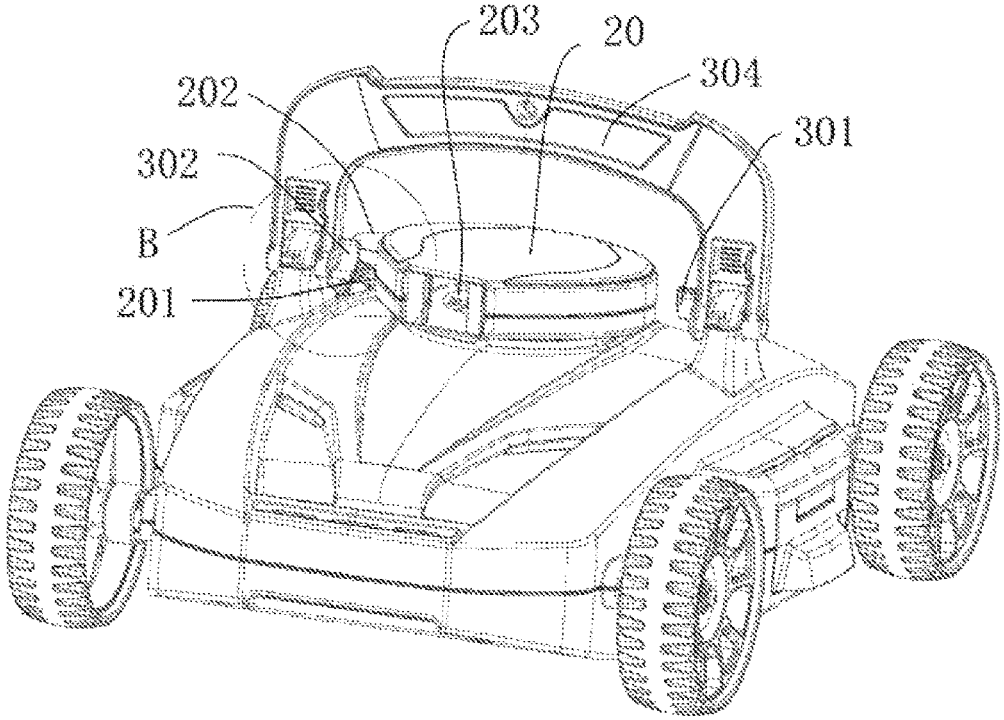
FIG. 5 schematically shows an example pool cleaning device in a stop state.

As shown in FIGS. 5 and 6, when the pool cleaning device 1 stops moving (e.g., when the pool cleaning device 1 touches a side wall of the pool and needs to be reversed), the buoyant plate 304 is no longer subjected to resistance but only to buoyancy, and thus rotates from an inclined state to a substantially vertical state. Accordingly, the first stopper 301 is driven by the buoyant plate 304 to rotate relative to the first positioning protrusion 201 to a substantially horizontal state, that is, at an angle of substantially 90 degrees with respect to the vertical direction, so as to be separated from the first positioning protrusion 201. The second stopper 302 is also driven by the buoyant plate 304 to rotate to a substantially vertical state, that is, at an angle of substantially 0 degree with respect to the vertical direction. The rotating member 20 rotates without obstruction until the rotating member 20 rotates through about 180 degrees, such that the second positioning protrusion 202 is stopped by the second stopper 302. At this point, the fluid outlet 203 is oriented in the first direction.

When the fluid outlet 203 is oriented toward the first direction, the pool cleaning device 1 can move only toward the second direction. The buoyant plate 304 rotates into an inclined state (e.g., being inclined toward the first direction) again under the combined effect of buoyancy and resistance. The second stopper 302 is driven by the buoyant plate 304 to rotate to deviate from the vertical direction by a small angle, for example, at an angle of substantially 20 degrees with respect to the vertical direction, to pass the second positioning protrusion 202 and be separated from the second positioning protrusion 202 and stop the first positioning protrusion 201 (that is, the second stopper 302 rotates to be between the second positioning protrusion 202 and the first positioning protrusion 201). At this point, a position state in which the first positioning protrusion 201 and the second stopper 302 both cooperate with each other can be seen in FIG. 4, and the first stopper 301 is at an angle of substantially 70 degrees with respect to the vertical direction. The rotating member 20 cannot rotate, such that the fluid outlet 203 remains oriented in the first direction, until the pool cleaning device 1 stops moving again.

During the use of the pool cleaning device 1, as the pool cleaning device 1 is stopped (e.g., by touching the side wall of the pool or an obstacle), the pool cleaning device can automatically reverse itself without human control or processor control, which may greatly facilitates its use and may greatly improve its pool cleaning efficiency. It may also reduces the cost of the pool cleaning device 1. In addition, the buoyant plate 304 can also be used as a carrying handle of the pool cleaning device 1, which further facilitates its use.

It should be noted that the fluid outlet 203 can also spray water during rotation of the rotating member 20 to drive the pool cleaning device 1 to move. This will not be further described herein.

As shown in FIG. 4, matching edges 204, matching with the first stopper 301 and the second stopper 302 respectively, of the first positioning protrusion 201 and the second positioning protrusion 202 are each constructed into a backward-recessed arc shape. The arc shape is adapted to the curved plate-like first stopper 301 and second stopper 302. In this way, the stoppers 303 can move smoothly and steadily relative to the first positioning protrusion 201 and the second positioning protrusion 202, which is conductive to smooth steering of the pool cleaning device 1. Herein, the term "backward" is used with reference to the rotation direction of the rotating member 20.

Figure 3:
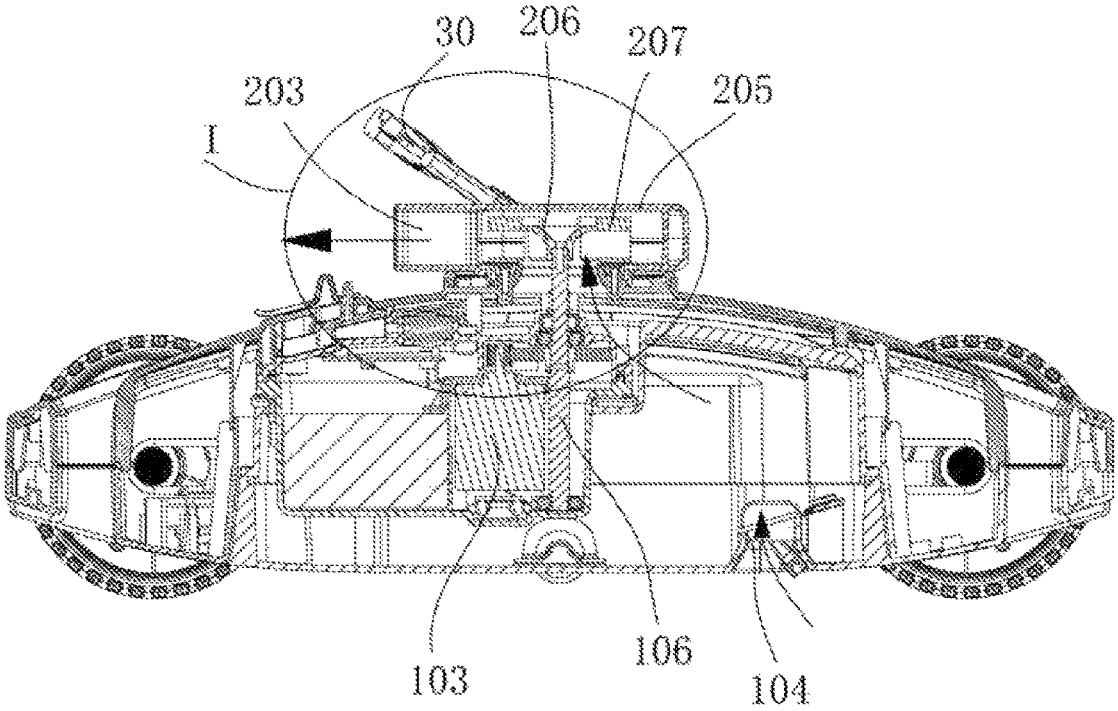
FIG. 3 is a cross-sectional view of FIG. 1.

As shown in FIG. 3, the rotating member 20 comprises a housing 205 and an impeller 206 disposed in the housing 205. The main body 10 carries an electric motor 103. The electric motor 103 drives the impeller 206 to rotate via a transmission mechanism, thereby driving the housing 205 to rotate. For example, the main body 10 is provided with a first shaft hole 408, and the housing 205 is provided with a second shaft hole 409 corresponding to the first shaft hole 408 (see FIG. 8). A shaft 106, connected to the electric motor 103, extends from inside the main body 10 through the first shaft hole 408 and the second shaft hole 409, and is connected to the impeller 206, such that the electric motor 103 drives the impeller 206 to rotate at a high speed via the shaft 106 to allow water to be sprayed at a high speed from the fluid outlet 203, thereby driving the pool cleaning device 1 to move. In addition, when the rotating member 20 is not prevented from rotating, the housing 205 is driven to rotate by the water sprayed at a high speed at the fluid outlet 203, thereby achieving rotation of the rotating member 20, and then achieving the purpose of adjusting the direction of the fluid outlet 203.

Optionally, a fluid passage that is in communication with the outside and the inside of the housing 205 is also constructed in the main body 10. As shown in FIG. 3, an inlet 104 of the fluid passage is located in a lower portion of the main body 10. A direction of water flow is shown by an arrow in FIG. 3.

Optionally, the electric motor 103 is disposed inside the main body 10. This helps to reduce the movement resistance of the pool cleaning device 1, thereby reducing energy consumption. In addition, since the electric motor 103 is disposed inside the main body 10, the electric motor 103 is protected, which helps to prolong service life of the pool cleaning device 1.

Figure 7:
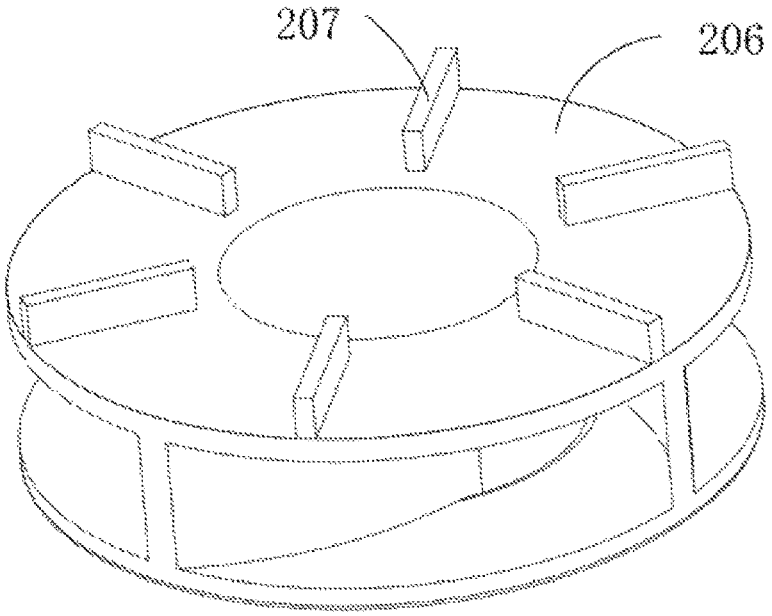
FIG. 7 schematically shows a structure of an impeller.

FIGS. 3 and 7 schematically show a structure of the impeller 206. As shown in FIG. 7, an upper surface of the impeller 206, facing away from the main body 10, is provided with a plurality of back vanes 207. When the impeller 206 rotates, the plurality of back vanes 207 reduce any axial force exerted by the rotating member 20 onto the main body 10, thereby helping to reduce a friction force between the rotating member 20 and the main body 10.

As shown in FIGS. 2 and 3, an annular groove 105 is provided in a surface of the main body 10 on the radially outer side of the first shaft hole 408. An annular wear-resistant part 107 is mounted in the annular groove 105. The rotating member 20 is in sliding contact with the wear-resistant part 107, such that the rotating member 20 (or the housing 205) is supported by the wear-resistant part 107. The wear-resistant part 107 separates the rotating member 20 from the main body 10, and the wear-resistant part 107 has a high wear resistance and also has some lubricity, which can reduce wear on the main body 10 and the rotating member 20 and enable the rotating member 20 to rotate flexibly. In one example embodiment, the wear-resistant part 107 may be a wear-resistant ceramic plate or wear-resistant nylon plate adhered to the annular groove 105.

It should be understood that the annular groove 105 may also be provided in the rotating member 20, which will not be further described herein.

Figure 8:
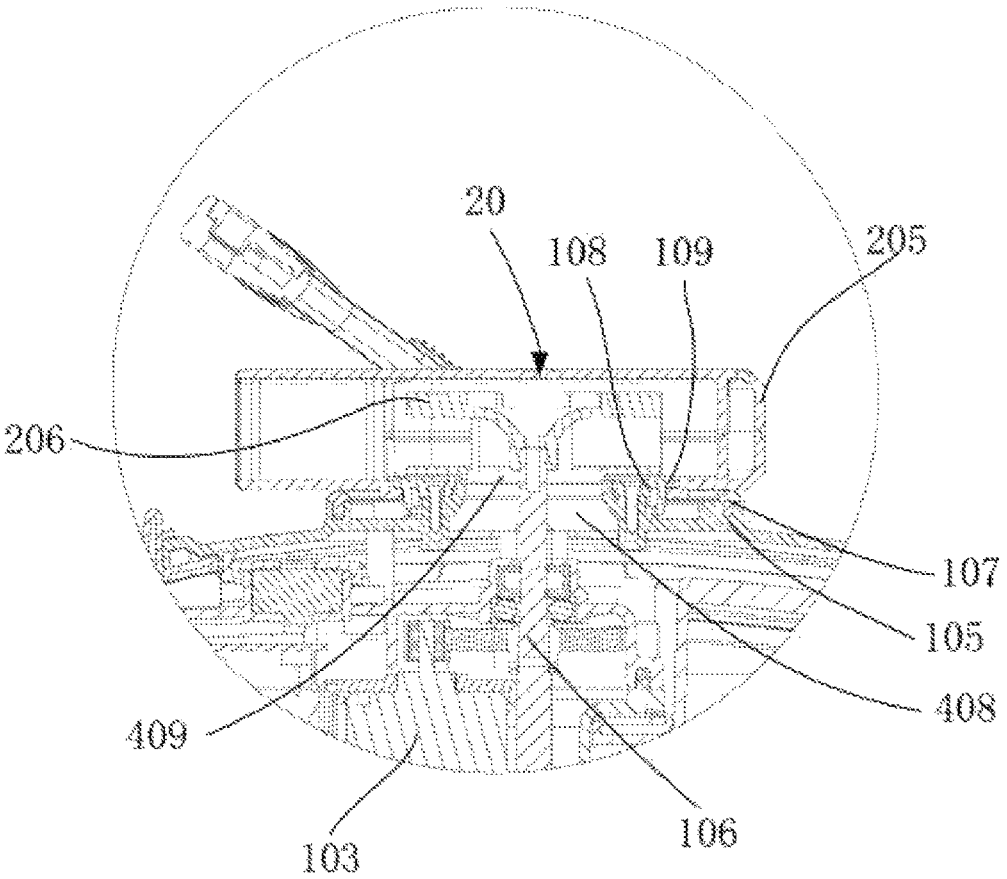
FIG. 8 is an enlarged view of part I of FIG. 3.

FIG. 8 shows a fitting relationship between the rotating member 20 and the main body 10. As shown in FIG. 8, a blocking ring 108 is also mounted on the main body 10 around the first shaft hole 408. The blocking ring 108 comprises an extension portion 109 extending radially outward from the first shaft hole 408. A circumferential edge portion of the second shaft hole 409 of the housing 205 is below the extension portion 109 and stopped by the extension portion 109 so as to prevent the housing 205 (i.e., the rotating member 20) from moving upward. In this way, the rotating member 20 is stable on the main body 10 with a stopping effect of the blocking ring 108 and a supporting effect of the wear-resistant part 107. It should be understood that the extension portion 109 may be used to prevent the housing 205 (i.e., the rotating member 20) from moving upward but does not apply a resistance to the rotation of the rotating member 20.

Optionally, as shown in FIG. 8, the blocking ring 108 may be mounted at the edge of the first shaft hole 408, such that the blocking ring 108 is on the radially inner side of the wear-resistant part 107. In other example embodiments, the blocking ring 108 may also be radially away from the first shaft hole 408 and on the radially outer side of the wear-resistant part 107, and the extension portion 109 may extend radially inward or radially outward. In this case, a flange may be constructed on the housing 205 that fits with the extension portion 109 of the blocking ring 108, which will not be described herein.

Figure 16:
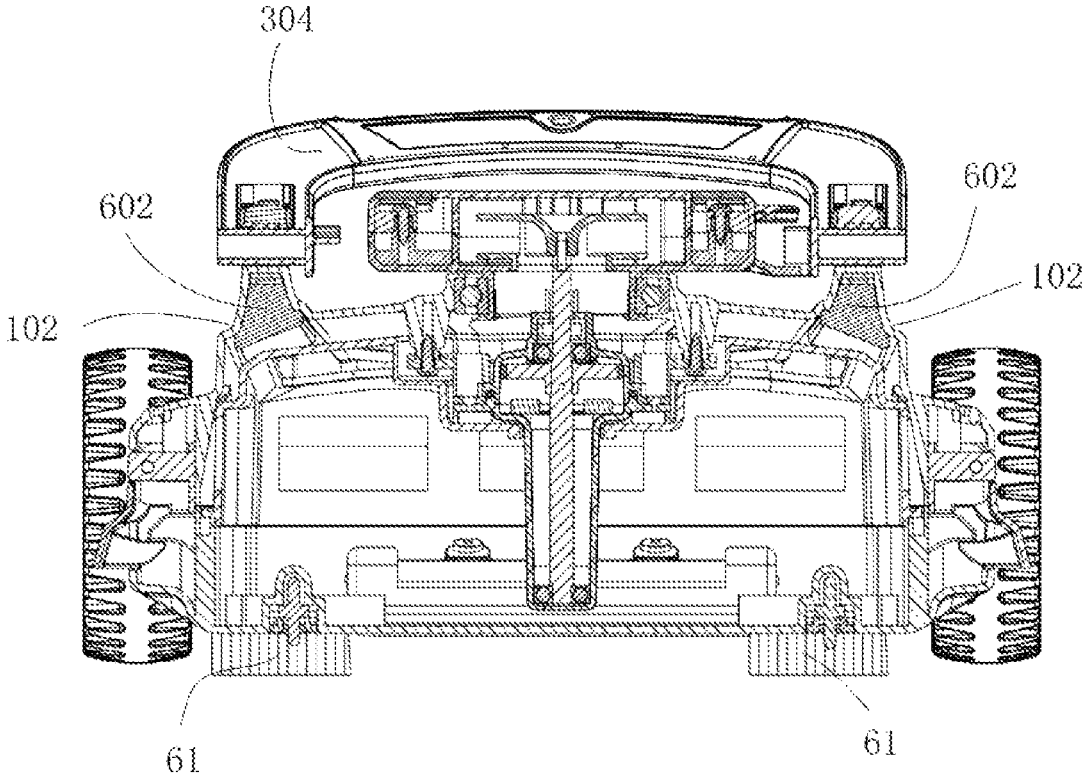
FIG. 16 is another cross-sectional view of the pool cleaning device according to the fourth example embodiment.

Optionally, a brush 61 (as shown in FIG. 16) may be mounted at the bottom of the main body 10. The brush 61 can brush the bottom surface of the pool when the pool cleaning device 1 moves along the bottom surface of the pool. In one example embodiment, a plurality of brushes 61 are provided and are uniformly disposed on the bottom of the main body 10.

Figure 9:
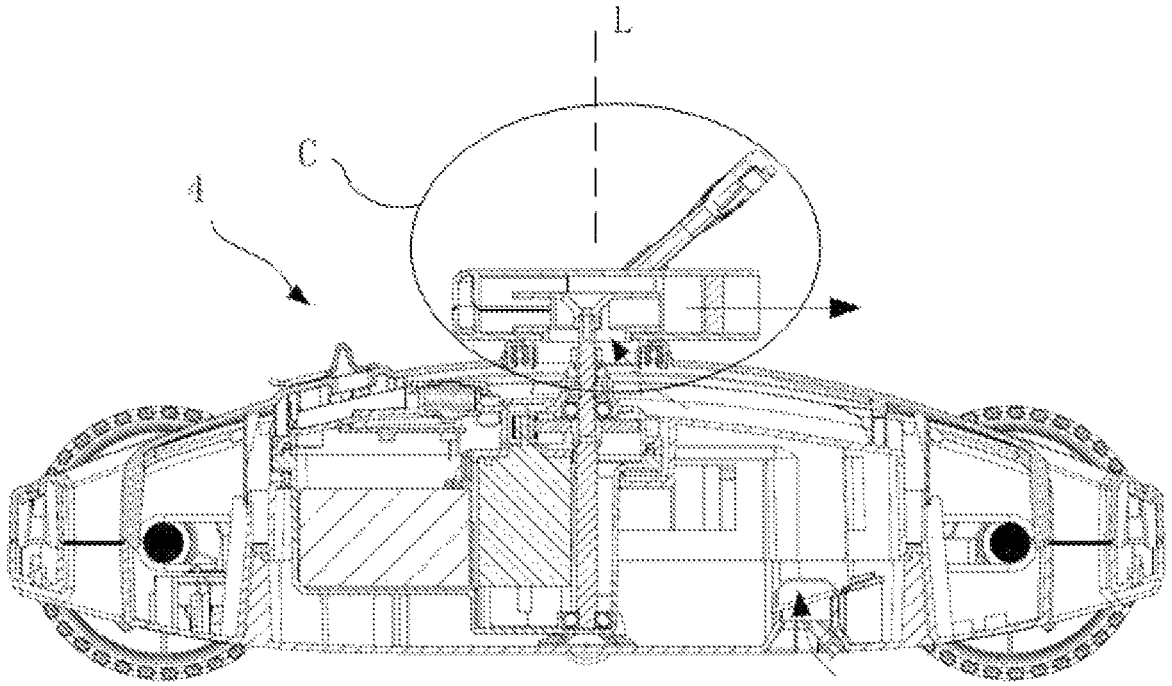
FIG. 9 schematically shows a cross-sectional view of a pool cleaning device according to a second example embodiment.

FIG. 9 schematically shows a pool cleaning device 4 according to a second example embodiment. The pool cleaning device 4 according to the second example embodiment is substantially the same as the pool cleaning device 1 according to the first example embodiment, except for the fitting relationship between the rotating member 20 and the main body 10. For the sake of simplicity, only the above difference is described below.

Figure 10:
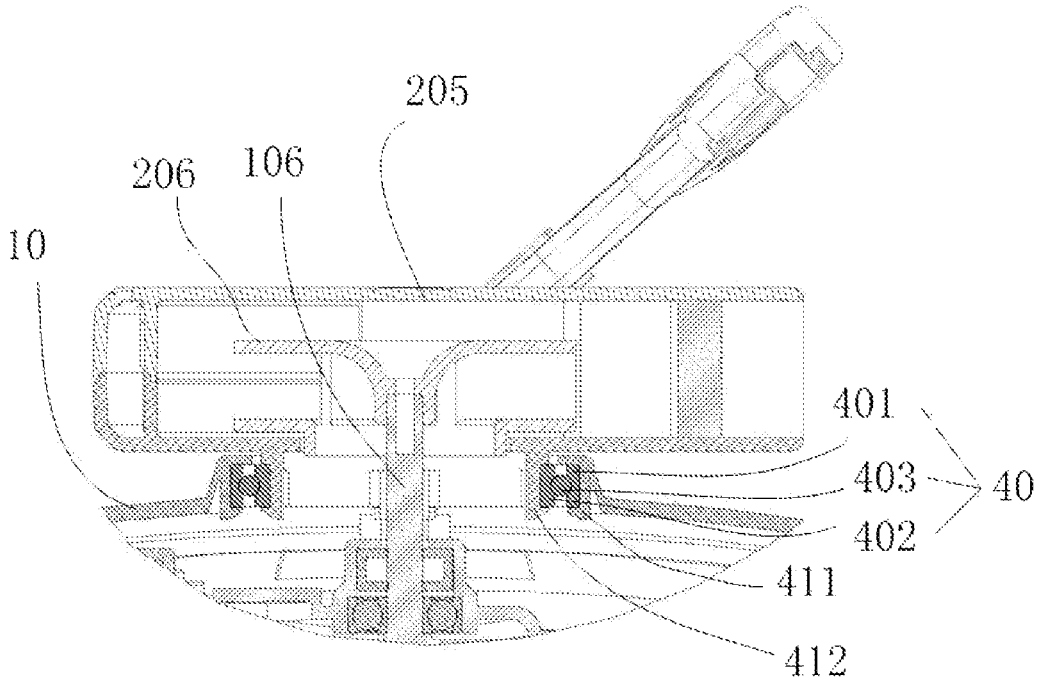
FIG. 10 is an enlarged view of part C f FIG. 9.

As shown in FIGS. 9 and 10, a bearing 40 is vertically provided between the housing 205 of the rotating member 20 and the main body 10 to separate the housing 205 from the main body 10. In this way, mutual wear between the housing 205 and the main body 10 can be limited.

Figure 11:
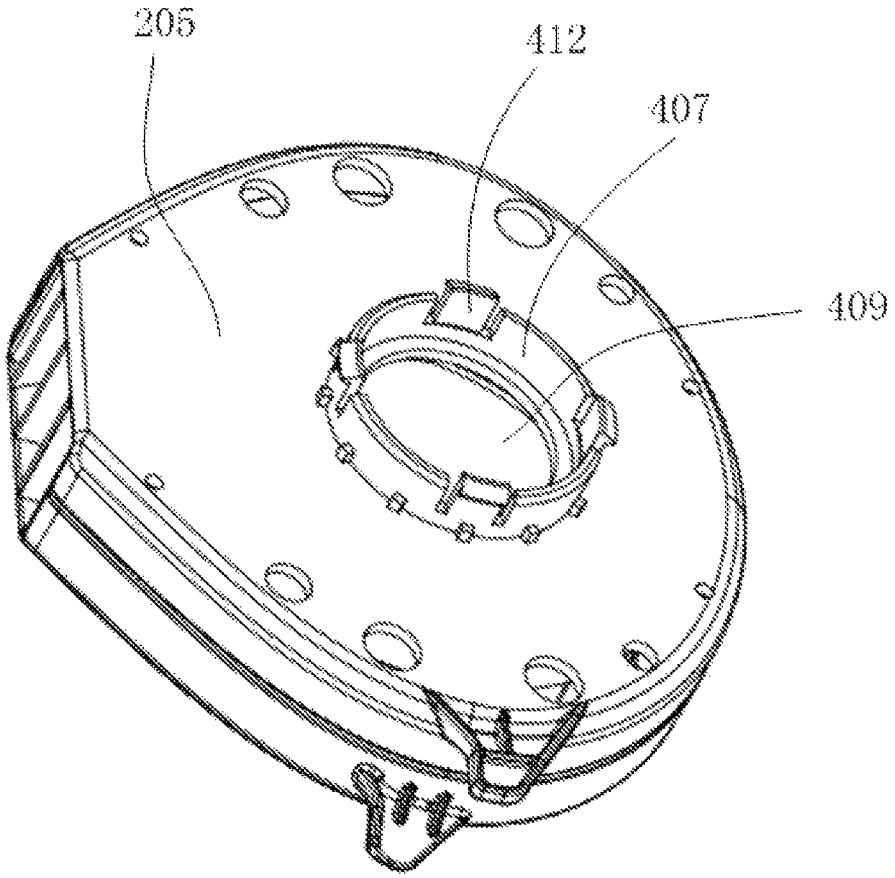
FIG. 11 schematically shows a rotating member of a pool cleaning device according to the second example embodiment.
Figure 12:
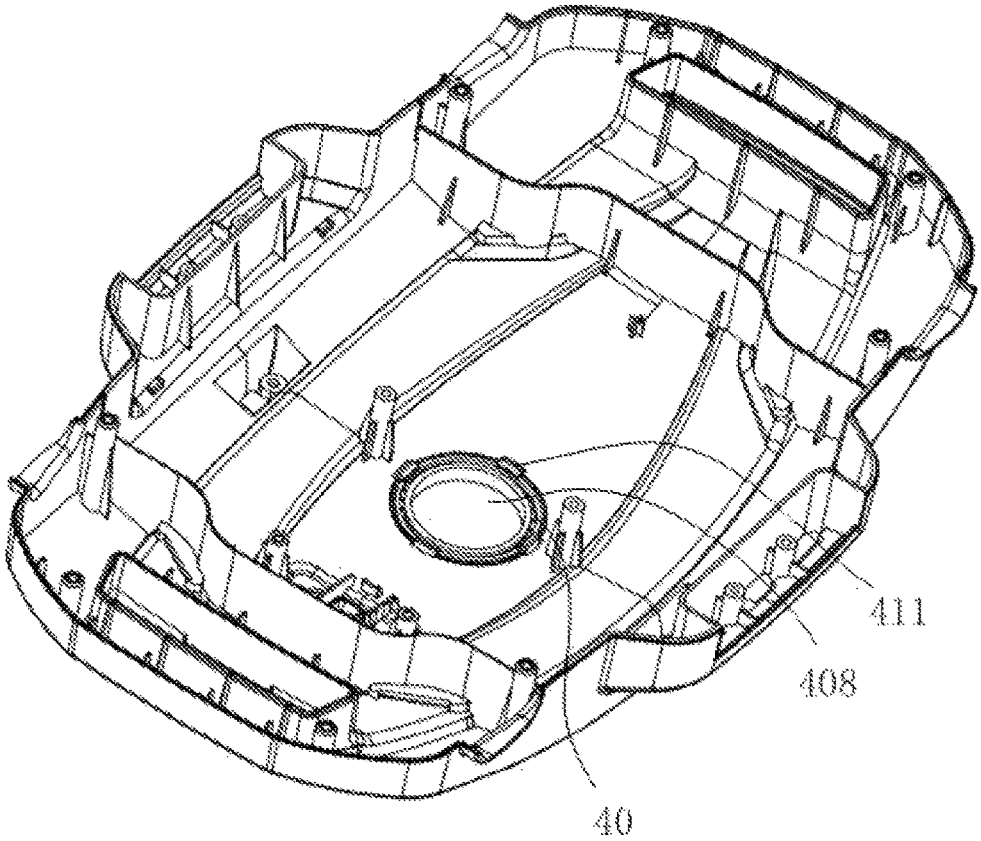
FIG. 12 schematically shows a main body, on which a bearing is mounted, of the pool cleaning device according to the second example embodiment.

Optionally, still as shown in FIG. 10, a first hook 411 extending vertically may be constructed in an area of the main body 10 corresponding to the housing 205, and a second hook 412 extending vertically is constructed in an area of the housing 205 corresponding to the main body 10. For example, as shown in FIG. 12, four first hooks 411 are provided and are uniformly formed at the edge of the first shaft hole 408. As shown in FIG. 11, four second hooks 412 are also provided and are uniformly formed at the edge of the second shaft hole 409. The bearing 40 comprises an outer race 401, an inner race 402, and rollers 403 disposed between the outer race 401 and the inner race 402. The outer race 401 is mounted to the first hook 411 and the inner race 402 is mounted to the second hook 412. Thus, stable mounting of the bearing 40 is achieved.

Optionally, still as shown in FIG. 11, an extension wall 407 may also be formed between adjacent second hooks 412. The extension wall 407 abuts against the inner race 402, thereby improving the fitting stability between the housing 205 (i.e., the rotating member 20) and the bearing 40.

Figure 13:
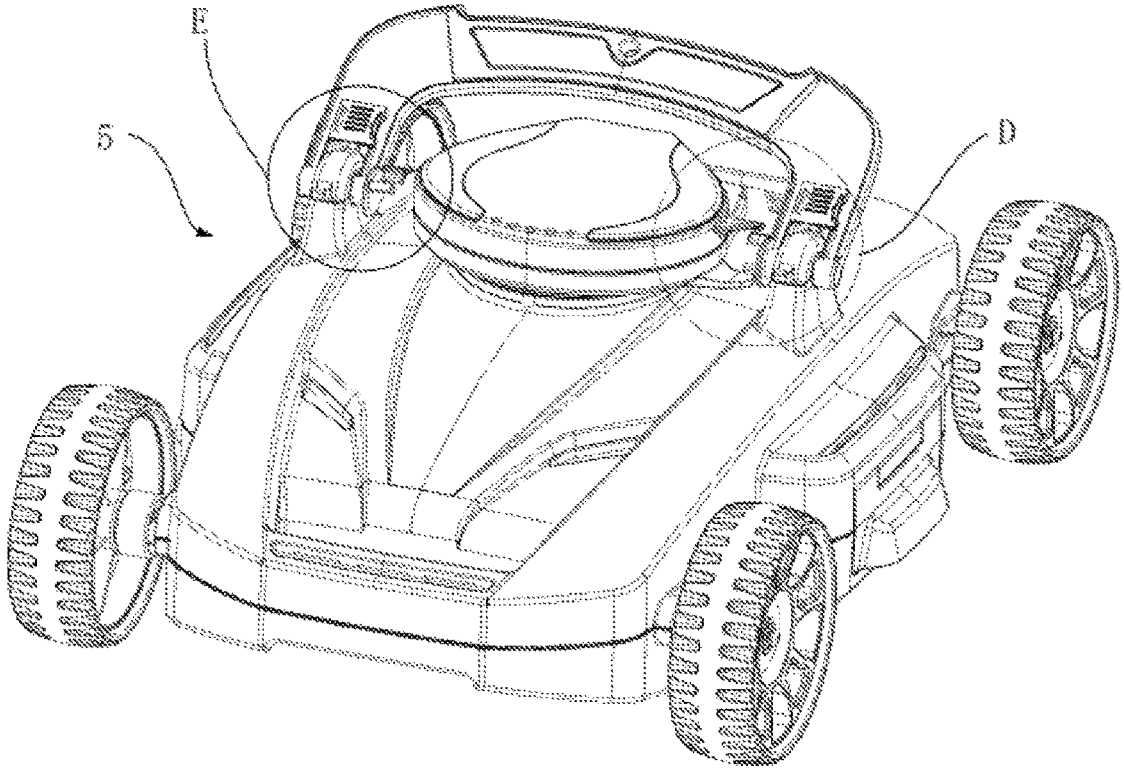
FIG. 13 schematically shows a pool cleaning device according to a third example embodiment, illustrating an example stopper in a second form.

FIG. 13 schematically shows a pool cleaning device 5 according to a third example embodiment. The pool cleaning device 5 according to the third example embodiment is substantially the same as the pool cleaning device 1 according to the first example embodiment, except for the structure of the stoppers 303. For the sake of simplicity, only the above difference is described below.

Figure 14A:
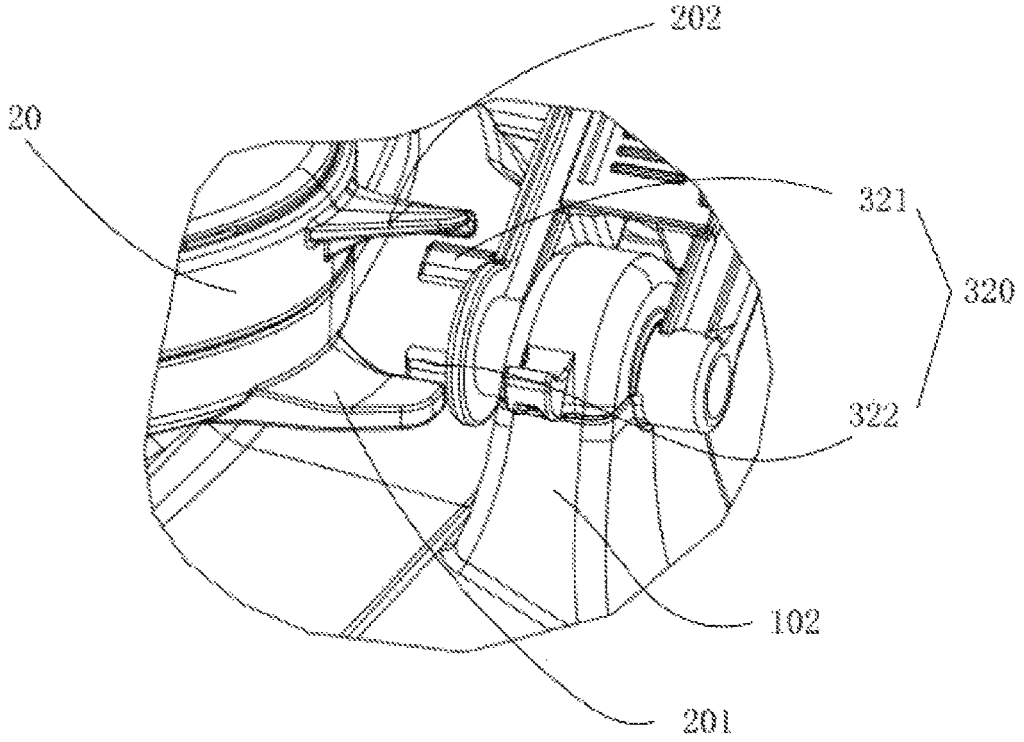
FIG. 14*a* is an enlarged view of part D of FIG. 13.

As shown in FIG. 14*a*, a first stopper 320 comprises a first blocking bar 321 and a second blocking bar 322. The first blocking bar 321 and the second blocking bar 322 are on the same circumference and are spaced apart, such that the first blocking bar 321 forms a first stop position and the second blocking bar 322 forms a second stop position. As a whole, compared with FIG. 4, the first stopper 320 shown in FIG. 14 is equivalent to two radial edges of the curved plate-like first stopper 301 shown in FIG. 4.

During use, the first blocking bar 321 and the second blocking bar 322 have the same effect as the curved plate-like first stopper 301, which will not be described herein.

Figure 14B:
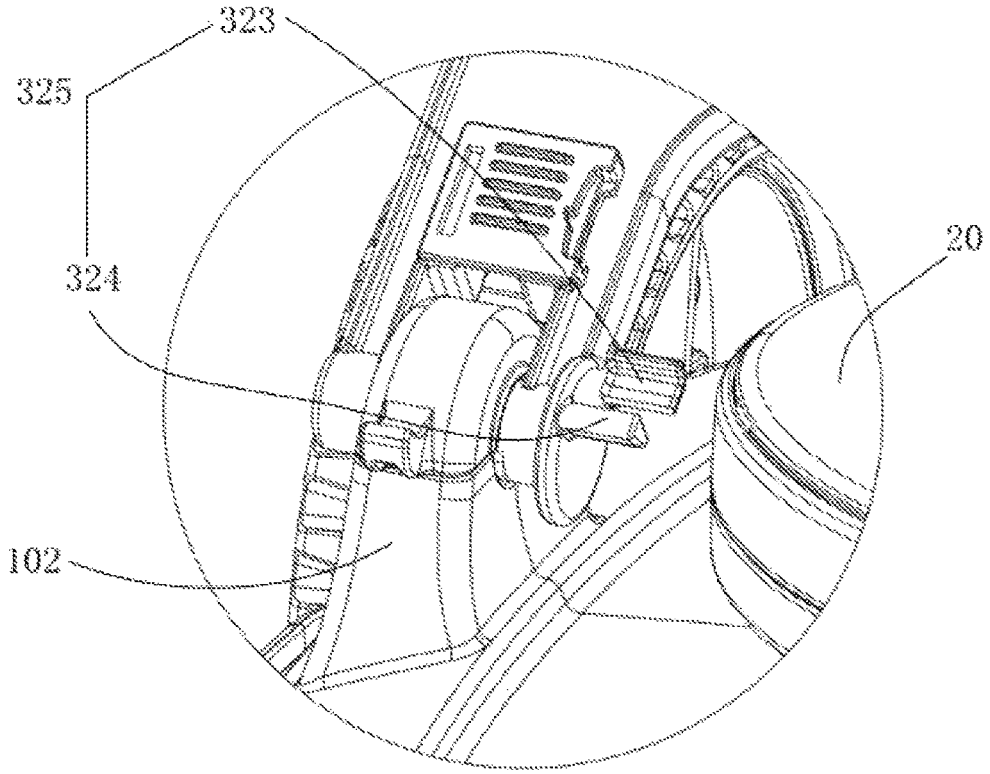
FIG. 14*b* is an enlarged view of part E of FIG. 13.

As shown in FIG. 14*b*, a second stopper 325 of the pool cleaning device 5 has the same structure as the first stopper 320, that is, it comprises a third blocking bar 323 that forms a third stop position and a fourth blocking bar 324 that forms a fourth stop position, the third blocking bar and the fourth blocking bar being on the same circumference and spaced apart. During use, the second stopper of the pool cleaning device 5 has the same effect as the curved plate-like second stopper 302, which will not be described herein.

When using the pool cleaning device 5, the first stopper and second stopper in the form described above may help to reduce the resistance of water, making the pool cleaning device 5 more energy efficient.

Figure 15:
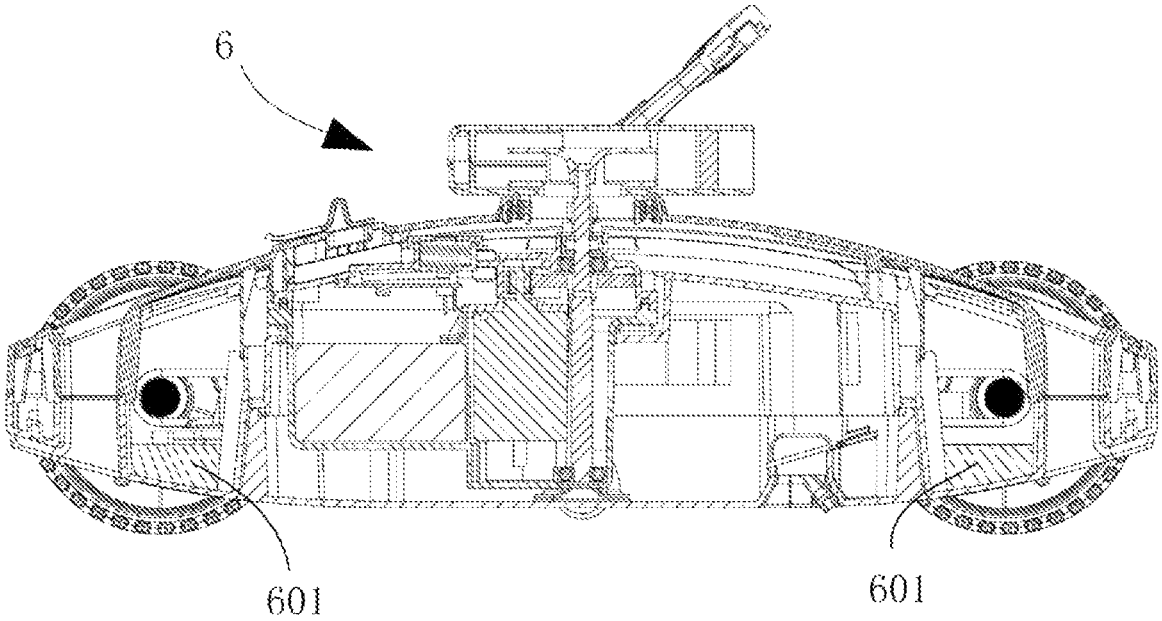
FIG. 15 schematically shows a pool cleaning device according to a fourth example embodiment, which is provided with a counterweight.

FIG. 15 schematically shows a pool cleaning device 6 according to a fourth example embodiment. The pool cleaning device 6 according to the fourth example embodiment is substantially the same as the pool cleaning device 1 according to the first example embodiment, with a counterweight provided in the main body 10. For the sake of simplicity, only the above difference is described below.

The counterweight may comprise a weight block 601. The weight block 601 has a density greater than that of water and may be, for example, a concrete block or a metal block. Still as shown in FIG. 15, the weight block 601 may be disposed at the bottom of the main body 10. In this way, the weight block 601 can increase the dead weight of the pool cleaning device 6 and lower the center of gravity of the pool cleaning device 6 to prevent the pool cleaning device 6 from being overturned by an external force (e.g., water in the pool shakes to produce a thrust on the pool cleaning device 6).

Optionally, a plurality of weight blocks 601 may be provided, and may be uniformly distributed inside the main body 10. For example, as shown in FIG. 15, the weight blocks 601 are arranged at front and rear portions inside the main body 10 in the moving direction T. This enables a more even distribution of mass of the pool cleaning device 6, such that the pool cleaning device 6 is more stable when moving. It should be understood that counterweights can also be provided at other locations inside the main body 10, which will not be described herein.

Optionally, the weight blocks 601 can be replaced to change the weight of the pool cleaning device 6 according to the actual situation, such that the pool cleaning device 6 can move more smoothly in different pools.

Optionally, the counterweight may further comprise a buoyant block 602. The buoyant block 602 has a density that is less than an average density of the main body 10, for example, the main body 10 is made of plastic, while the buoyant block 602 may be a foam block. The buoyant block 602 may reduce the dead weight of the pool cleaning device 6, which helps to reduce the movement resistance of the pool cleaning device 6, such that the pool cleaning device 6 can move more smoothly.

Optionally, similar to the weight blocks 601, a plurality of buoyant blocks 602 may be provided and are uniformly distributed inside the main body 10. For example, as shown in FIG. 16, the mounting bases 102 are each constructed as a hollow structure and the buoyant block 602 is filled in the mounting base 102. In addition, similar to the weight blocks 601, the buoyant blocks 602 can be replaced. This will not be described herein.

Optionally, both the weight blocks 601 and the buoyant blocks 602 can be provided in the pool cleaning device 6, or the weight blocks 601 or the buoyant blocks 602 can be selectively provided, according to the actual situation. In this way, the movement resistance and movement stability of the pool cleaning device 6 can be adjusted more precisely.

It may be understood that the exemplary embodiments described herein may be considered in a descriptive sense only and not for purposes of limitation. Descriptions of features or aspects within each exemplary embodiment may be considered as available for other similar features or aspects in other exemplary embodiments.

While exemplary embodiments have been described with reference to the figures, it will be understood by those of ordinary skill in the art that various changes in form and details may be made therein without departing from the spirit and scope as defined by the following claims.

What is claimed is:

1. A pool cleaning device, comprising:

a main body;

a rotating unit rotatably disposed on the main body, the rotating unit comprising: a rotating member, a fluid outlet extending radially outward from the rotating member, and a first positioning protrusion extending radially outward from the rotating member and spaced apart from the fluid outlet; and a reversing member comprising a plurality of stoppers spaced apart from each other and disposed along a path of rotation of the rotating member, wherein each of the plurality of stoppers is reciprocable between a position in a path of rotation of the first positioning protrusion and a position out of the path of rotation of the first positioning protrusion.

2. The pool cleaning device according to claim 1, wherein:

the plurality of stoppers are synchronously rotatable, and a path of rotation of each of the plurality of stoppers intersects with the path of rotation of the first positioning protrusion; and each of the stoppers is disposed at an angle, with respect to a vertical direction, different from an angle at which each other of the stoppers is disposed.

3. The pool cleaning device according to claim 2, wherein:

the plurality of stoppers comprise a first stopper and a second stopper arranged symmetrically with respect to a moving direction of the pool cleaning device;

the first stopper comprises a first stop position and a second stop position, the first stop position and the second stop position being on a first circumference and spaced apart;

the second stopper comprises a third stop position and a fourth stop position, the third stop position and the fourth stop position being on a second circumference and spaced apart; and projections, toward each other, of an arc segment between the first stop position and the second stop position and a corresponding arc segment between the third stop position and the fourth stop position are orthogonal; and along the rotation path of the first positioning protrusion, the fluid outlet is arranged at a right angle to the first positioning protrusion.

4. The pool cleaning device according to claim 3, wherein the first stopper comprises a first curved plate and the second stopper comprises a second curved plates.

5. The pool cleaning device according to claim 3, wherein the first stopper comprises a first blocking bar forming the first stop position and a second blocking bar spaced apart from the first blocking bar and forming the second stop position; and the second stopper comprises a third blocking bar forming the third stop position and a fourth blocking bar spaced apart from the third blocking bar and forming the fourth stop position.

6. The pool cleaning device according to claim 3, wherein each of the first stopper and the second stopper is rotatably disposed on the main body.

7. The pool cleaning device according to claim 3, wherein:

the reversing member further comprises a buoyant plate, the buoyant plate extending across the rotating member and connected to the first stopper and the second stopper; and the rotating unit further comprises a second positioning protrusion extending radially outward from the rotating member, spaced apart from the first positioning protrusion, and disposed higher than the first positioning protrusion.

8. The pool cleaning device according to claim 7, further comprising:

a first mounting base extending upward from the main body;

a second mounting base extending upward from the main body and symmetrically disposed with respect to the first mounting base;

wherein a first end of the buoyant plate is rotatably mounted on the first mounting base, a second end of the buoyant plate is rotatably mounted on the second mounting base, the first stopper is disposed on the first end of the buoyant plate, the second stopper is disposed on the second end of the buoyant plate, facing the first stopper.

9. The pool cleaning device according to claim 7, wherein the first positioning protrusion comprises an edge having a recessed-arc shape corresponding to a shape of the first stopper, and the second positioning protrusion comprises an edge having a recessed-arc shape corresponding to a shape of the second stopper.

10. The pool cleaning device according to claim 1, wherein:

the plurality of stoppers comprise a first stopper and a second stopper arranged symmetrically with respect to a moving direction of the pool cleaning device;

the reversing member further comprises a buoyant plate which extends across the rotating member and comprises a first end rotatably connected to the first stopper and a second end rotatably connected to the second stopper, such that:

when the pool cleaning device is moving in a first direction, a combination of buoyancy of the buoyant plate and pressure from surrounding water maintains the buoyant plate in an inclined state;

when the pool cleaning device is not moving, the buoyancy of the buoyant plate lifts the buoyant plate into a vertical state; and when the pool cleaning device is moving in a second direction, a combination of the buoyancy of the buoyant plate and pressure from surrounding water maintains the buoyant plate the inclined state again.

11. The pool cleaning device according to claim 1, further comprising:

an electric motor and a transmission mechanism;

wherein the rotating unit further comprises a housing and an impeller disposed in the housing; and wherein the electric motor is operatively coupled to the impeller via the transmission mechanism.

12. The pool cleaning device according to claim 11, wherein:

the electric motor is disposed in the main body;

the main body comprises a first shaft hole formed therethrough, the housing comprises a second shaft hole formed therethrough in a position corresponding to a position of the first shaft hole; and the transmission mechanism extends through the first shaft hole, through the second shaft hole, and is operatively connected to the electric motor and to the impeller.

13. The pool cleaning device according to claim 12, further comprising:

an annular groove formed in a surface of one of the main body and the housing around a corresponding one of the first shaft hole and the second shaft hole, and an annular wear-resistant part mounted in the annular groove.

14. The pool cleaning device according to claim 12, further comprising a bearing is vertically disposed between the housing and the main body, thereby spacing the housing apart from the main body.

15. The pool cleaning device according to claim 14, further comprising:

a first hook extending vertically in an area of the main body corresponding to the housing, and a second hook extending vertically in an area of the housing corresponding to the main body;

wherein the bearing comprises an outer race, an inner race, and rollers disposed between the outer race and the inner race; and wherein the outer race is mounted to the first hook, and the inner race is mounted to the second hook.

16. The pool cleaning device according to claim 11, further comprising a plurality of back vanes disposed on an outer surface of the impeller and extending away from the main body.

17. The pool cleaning device according to claim 1, further comprising a counterweight disposed in the main body.

18. The pool cleaning device according to claim 1, further comprising a plurality of counterweights uniformly distributed within the main body.

19. The pool cleaning device according to claim 17, wherein the counterweight comprises one of a weight block and a buoyant block.

20. A pool cleaning device, comprising:

a main body;

a rotating unit rotatably disposed on the main body, the rotating unit comprising: a rotating member, a fluid outlet extending radially outward from the rotating member, a first positioning protrusion extending radially outward from the rotating member, and a second positioning protrusion, spaced apart from the first positioning protrusion and extending radially outward from the rotating member; and a reversing member comprising: a first stopper and a second stopper arranged symmetrically with respect to a moving direction of the pool cleaning device, and a buoyant plate extending across the rotating member and connected to the first stopper and the second stopper;

wherein the pool cleaning device is positionable into:

a first service state in which the pool cleaning device moves in a first direction, the buoyant plate is in an inclined state, the first stopper stops the first positioning protrusion, and the fluid outlet is oriented in a second direction opposite the first direction;

a transition state in which the pool cleaning device stops moving, the buoyant plate is rotated into a vertical state, the first stopper is rotated to separate from the first positioning protrusion, the rotating member rotates until the second stopper contacts the second positioning protrusion, and the fluid outlet is oriented in the first direction, and a second service state in which the buoyant plate is deflected into the inclined state, the second stopper rotates past the second positioning protrusion until the second stopper contacts the first positioning protrusion, and the fluid outlet remains oriented in the first direction.

* * * * *